US009784269B2

(12) United States Patent
Lehr et al.

(10) Patent No.: US 9,784,269 B2
(45) Date of Patent: Oct. 10, 2017

(54) HYDRAULIC TOOLS INCLUDING INSERTS AND RELATED METHODS

(71) Applicant: Baker Hughes Incorporated, Houston, TX (US)

(72) Inventors: Joerg Lehr, Celle (DE); Dirk Froehlich, Sehnde (DE); Carsten Hohl, Sehnde (DE)

(73) Assignee: Baker Hughes Incorporated, Houston, TX (US)

( * ) Notice: Subject to any disclaimer, the term of this patent is extended or adjusted under 35 U.S.C. 154(b) by 235 days.

(21) Appl. No.: 14/148,489

(22) Filed: Jan. 6, 2014

(65) Prior Publication Data

US 2015/0192123 A1 Jul. 9, 2015

(51) Int. Cl.

| | |
|---|---|
| ***F03C 2/22*** | (2006.01) |
| ***F04C 2/16*** | (2006.01) |
| ***F04C 2/107*** | (2006.01) |
| ***F04C 5/00*** | (2006.01) |
| ***F04C 18/107*** | (2006.01) |
| ***F04C 13/00*** | (2006.01) |

(52) U.S. Cl.

CPC ..... *F04C 13/008* (2013.01); *F04C 2/1071* (2013.01); *F04C 2/1075* (2013.01); *F04C 2230/91* (2013.01); *F05C 2251/10* (2013.01)

(58) Field of Classification Search

CPC ..... F04C 2/1075; F04C 2/1071
USPC ..... 418/152–155, 48, 178, 179
See application file for complete search history.

(56) References Cited

U.S. PATENT DOCUMENTS 5,395,221 A * 3/1995 Tucker, Jr. ..... F01C 21/08 418/178
6,354,824 B1 * 3/2002 Mills ..... F04C 2/084 418/152
7,066,271 B2 6/2006 Chen et al.
(Continued)

FOREIGN PATENT DOCUMENTS

JP 61-192880 * 8/1986 ..... F04C 2/14
JP 61192880 A * 8/1986
(Continued)

OTHER PUBLICATIONS

Hardness of Materials, Ted Pella, Inc. (Based on the wayback search, it was publised earlier than 2006).*
(Continued)

*Primary Examiner* — Deming Wan
(74) *Attorney, Agent, or Firm* — TraskBritt

(57) ABSTRACT

A hydraulic tool includes a stator and a rotor rotatably disposed within the stator. At least one of at least an inner portion of the stator and at least an outer portion of the rotor includes an insert comprising a hard material. A method of forming a hydraulic tool includes attaching at least one insert comprising a hard material to a surface of a stator or a surface of a rotor. A downhole motor or pump includes a stator and a rotor. The stator includes at least one insert comprising a hard material disposed over at least a portion of an interior surface thereof and a matrix material at least partially surrounding the at least one insert. The rotor includes at least one insert disposed over at least a portion of an exterior surface thereof and a matrix material at least partially surrounding the at least one insert.

20 Claims, 16 Drawing Sheets

(56) References Cited

U.S. PATENT DOCUMENTS

| | | | | |
|---|---|---|---|---|
| 2005/0029808 | A1* | 2/2005 | Zolnier | C23C 24/04 285/261 |
| 2006/0182644 | A1 | 8/2006 | Delpassand et al. | |
| 2007/0071921 | A1 | 3/2007 | Coulas | |
| 2008/0206576 | A1* | 8/2008 | Qian | B24D 3/10 428/446 |
| 2008/0304992 | A1 | 12/2008 | Hooper et al. | |
| 2010/0038142 | A1* | 2/2010 | Snyder | E21B 4/02 175/107 |
| 2011/0070111 | A1* | 3/2011 | Slay | F04C 2/1075 417/477.4 |
| 2011/0150686 | A1* | 6/2011 | Trushin | E21B 4/02 418/48 |
| 2012/0018227 | A1* | 1/2012 | Puzz | E21B 4/02 175/107 |
| 2012/0148432 | A1* | 6/2012 | Butuc | F04C 2/1075 418/48 |
| 2012/0160569 | A1 | 6/2012 | Hummes | |
| 2013/0000986 | A1 | 1/2013 | Dick | |
| 2013/0014995 | A1* | 1/2013 | Scott | C22C 26/00 175/107 |
| 2013/0048384 | A1 | 2/2013 | Jarvis et al. | |
| 2013/0056443 | A1 | 3/2013 | Ramier et al. | |
| 2013/0287616 | A1 | 10/2013 | Guidry, Jr. | |

FOREIGN PATENT DOCUMENTS

| | | | |
|---|---|---|---|
| WO | 2012122321 | A2 | 9/2012 |
| WO | 2013074865 | A1 | 5/2013 |
| WO | 2013081804 | A2 | 6/2013 |

OTHER PUBLICATIONS

Machine English Translation JP61192880 by J Piat Pat Sep. 26, 2016.*

International Search Report for International Application No. PCT/US2015/010092 mailed Apr. 17, 2015, 3 pages.

International Written Opinion for International Application No. PCT/US2015/010092 mailed Apr. 17, 2015, 9 pages.

* cited by examiner

HYDRAULIC TOOLS INCLUDING INSERTS AND RELATED METHODS

FIELD

Embodiments of the present disclosure relate generally to hydraulic tools, such as drilling motors and pumps, to drilling systems that include hydraulic tools, and to methods of forming and using such tools and systems.

BACKGROUND

To obtain hydrocarbons such as oil and gas from subterranean formations, wellbores are drilled into the formations by rotating a drill bit attached to an end of a drill string. A substantial portion of current drilling activity involves what is referred to in the art as "directional" drilling. Directional drilling involves drilling deviated and/or horizontal wellbores (as opposed to straight, vertical wellbores). Modern directional drilling systems generally employ a bottom hole assembly (BHA) at the end of the drill string that includes a drill bit and a hydraulically actuated motor to drive rotation of the drill bit. The drill bit is coupled to a drive shaft of the motor, typically through an assembly configured for steering the path of the drill bit, and drilling fluid pumped through the motor (and to the drill bit) from the surface drives rotation of the drive shaft to which the drill bit is attached. Such hydraulic motors are commonly referred to in the drilling industry as "mud motors," "drilling motors," and "Moineau motors." Such motors are referred to hereinafter as "hydraulic drilling motors."

Hydraulic drilling motors include a power section that includes a stator and a rotor disposed in the stator. The stator may include a metal housing having an interior lined with a helically contoured or lobed elastomeric material, which material is formulated to wear. The elastomeric material may be replaced after a certain amount of use, or when a selected amount of wear or damage is detected. The rotor is usually made from a suitable metal, such as steel, and configured with an outer lobed surface. Pressurized drilling fluid (commonly referred to as "drilling mud") is pumped into a progressive cavity formed between the rotor and the stator lobes. The force of the pressurized fluid pumped into and through the cavity causes the rotor to turn in a planetary-type motion. An output shaft connected to the rotor via a flexible coupling compensates for eccentric movement of the rotor. The output shaft is coupled to a bearing assembly supporting a drive shaft (also referred to as a "drive sub"), which in turn rotates the drill bit through the aforementioned steering assembly.

As drilling fluid flows through the progressive cavity between the rotor and the stator, forces on the rotor and the stator, as well as abrasives and chemicals in the drilling fluid, can damage parts of the motor.

BRIEF SUMMARY

In some embodiments, a hydraulic tool includes a stator and a rotor rotatably disposed within the stator. The stator has a plurality of lobes, and the rotor has one fewer lobe than the stator. The lobes of the rotor are configured to engage with the lobes of the stator when the rotor moves (e.g., turns). At least one of at least an inner portion of the stator and at least an outer portion of the rotor comprises at least one insert comprising a hard material.

A method of forming a hydraulic tool (e.g., a motor or pump) includes attaching at least one insert comprising a hard material to an inner surface of a stator or an outer surface of a rotor of the hydraulic tool.

In other embodiments, a downhole motor or pump includes a stator and a rotor rotatably disposed within the stator. The stator comprises at least one insert comprising a hard material disposed over at least a portion of an interior surface thereof, and a matrix material at least partially surrounding the at least one insert. The rotor comprises at least one insert comprising a hard material disposed over at least a portion of an exterior surface thereof and a matrix material at least partially surrounding the at least one insert.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The present disclosure includes hydraulic tools (e.g., drilling motors, progressive cavity pumps, etc.) each having a stator and a rotor. The stator and/or the rotor include at least one insert comprising a hard material. The insert(s) may be located at position(s) on the stator and/or rotor likely to experience relatively high loads. The inserts may protect the surfaces of the stator and/or rotor from excessive wear. A composite matrix material between and/or partially surrounding the inserts may provide flexibility to the surface of the rotor and/or stator, which may reduce or prevent cracking of the inserts under stress. Thus, the tool may have a longer useful life than a conventional tool having a stator and rotor without inserts of hard material.

The illustrations presented herein are not actual views of any particular hydraulic tool, rotor, stator, hydraulic drilling motor, hydraulic pump, or drilling system, but are merely idealized representations that are employed to describe example embodiments of the present disclosure. Additionally, elements common between figures may retain the same numerical designation.

As used herein, the term "hard material" means and includes any material having a Knoop hardness value of about 800 $Kg_f/mm^2$ (7,845 MPa) or more. Hard materials include, for example, diamond, cubic boron nitride, tungsten carbide, etc.

The term "polycrystalline material" means and includes any material comprising a plurality of grains (i.e., crystals) of the material that are bonded directly together by intergranular bonds. The crystal structures of the individual grains of the material may be randomly oriented in space within the polycrystalline material.

As used herein, the term "earth-boring tool" means and includes any tool used to remove subterranean formation material and form a bore (e.g., a wellbore) through the formation by way of the removal of a portion of the formation material. Earth-boring tools include, for example, rotary drill bits (e.g., fixed-cutter or "drag" bits and roller-cone or "rock" bits), hybrid bits including both fixed cutters and roller elements, coring bits, percussion bits, bi-center bits, casing mills and drill bits, exit tools, reamers (including expandable reamers and fixed-wing reamers), and other so called "hole-opening" tools.

Figure 1A:
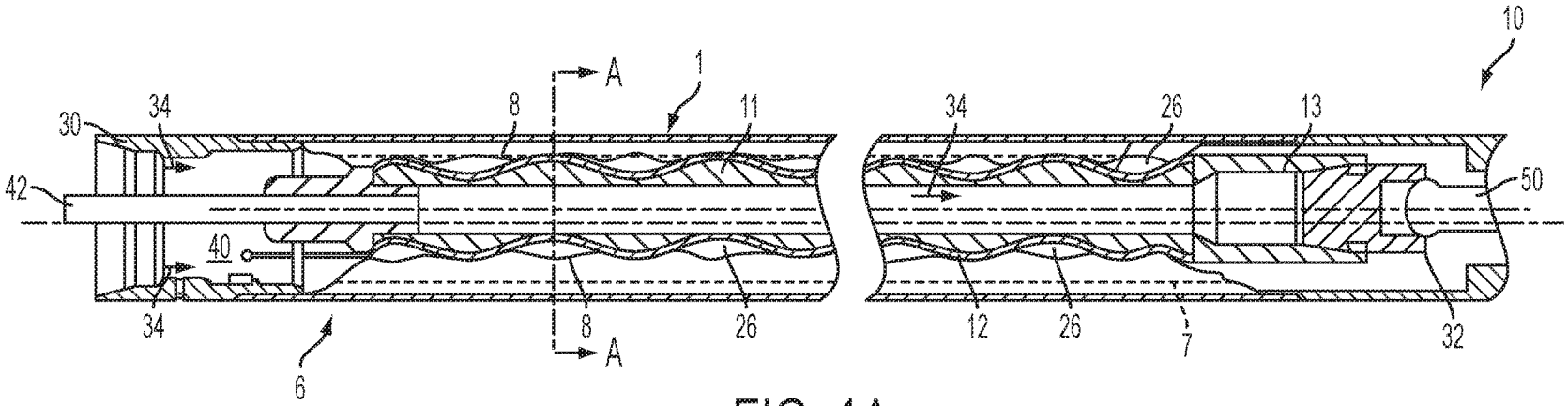
FIGS. 1A and 1B are simplified cross-sectional side views illustrating an embodiment of a hydraulic motor according to the present disclosure.
Figure 1B:
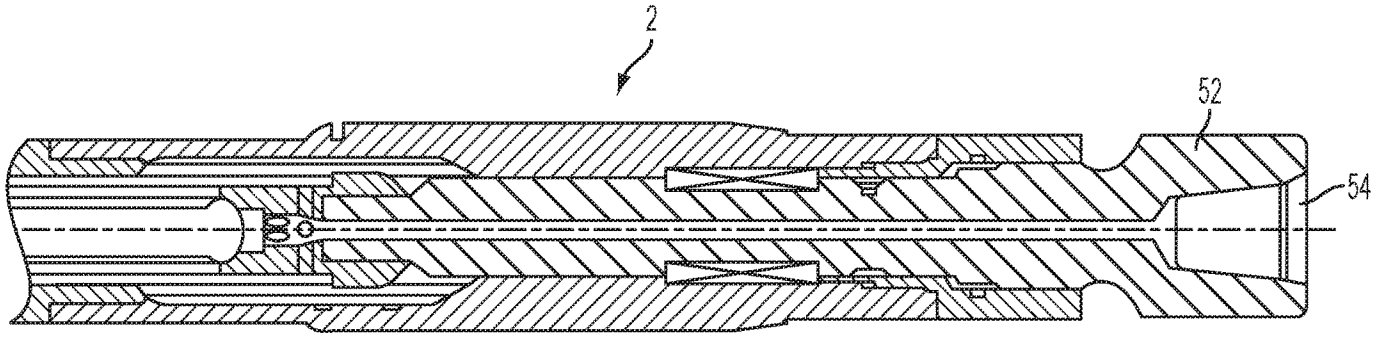

Referring to FIGS. 1A and 1B, a hydraulic drilling motor 10 includes a power section 1 and a bearing assembly 2. The power section 1 includes a stator 6 having a helically lobed inner surface 8. A rotor 11 is rotatably disposed within the stator 6 and configured to rotate therein (indicated by arrow 15) responsive to the flow of drilling fluid (e.g., a liquid or a suspension of solid particulate matter in a liquid) through the hydraulic drilling motor 10. The rotor 11 may include an elongated metal core 13 that has a helically lobed outer surface 12, and the stator 6 may include an elongated metal shell 7 with a helically lobed inner surface 8. The outer surface 12 of the rotor 11 is configured to engage with the inner surface 8 of the stator 6. The rotor 11 may also include one or more fluid connections 42 to provide pressurized fluid to the interior of the rotor 11.

The outer surface 12 of the rotor 11 and the inner surface 8 of the stator 6 may have similar, but slightly different profiles. For example, the outer surface 12 of the rotor 11 may have one fewer lobe than the inner surface 8 of the stator 6. The outer surface 12 of the rotor 11 and the inner surface 8 of the stator 6 may be configured so that seals are established directly between portions of the rotor 11 and the stator 6 at discrete intervals along and circumferentially around the interface therebetween, resulting in the creation of fluid chambers or cavities 26 between the outer surface 12 of the rotor 11 and the inner surface 8 of the stator 6. The rotor 11 and the stator 6 may each include a metal and/or a hard material, and the contact between the rotor 11 and the stator 6 during operation of the hydraulic drilling motor 10 may be characterized as metal-to-metal if neither the outer surface 12 of the rotor 11 nor the inner surface 8 of the stator 6 includes an elastomeric material. In operation of the hydraulic drilling motor 10, cavities 26 may be filled with a pressurized drilling fluid 40.

As the pressurized drilling fluid 40 flows from a top 30 to a bottom 32 of the power section 1, as shown by flow arrow 34, the pressurized drilling fluid 40 causes the rotor 11 to rotate within the stator 6. The number of lobes and the geometries of the outer surface 12 of the rotor 11 and inner surface 8 of the stator 6 may be modified to achieve desired input (i.e., fluid flow rate and volume) and output (i.e., rotational speed and torque) requirements and to accommodate different drilling operations. The rotor 11 may be coupled to a flexible shaft 50, and the flexible shaft 50 may be connected to a drive shaft 52 in the bearing assembly 2. As previously mentioned, a drill bit may be attached to the drive shaft 52. For example, the drive shaft 52 may include a threaded box 54, and a drill bit may be provided with a threaded pin that may be engaged with the threaded box 54 of the drive shaft 52.

Figure 2:
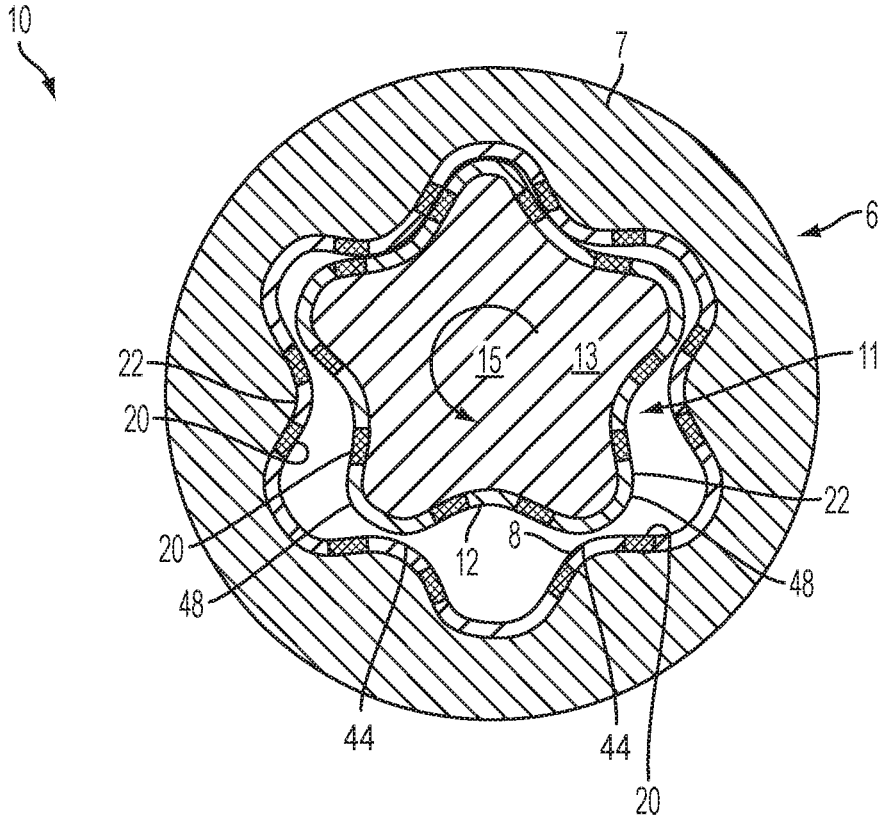
FIG. 2 is a simplified transverse cross-sectional view of a portion of the hydraulic motor shown in FIGS. 1A and 1B taken along section line A-A therein.

FIG. 2 is a cross-sectional view of the stator 6 and the rotor 11 of the hydraulic drilling motor 10 taken at section A-A of FIG. 1A. As shown in FIG. 2, either a portion of the stator 6 adjacent its inner surface 8, a portion of the rotor 11 adjacent its outer surface 12, or both may include one or more inserts 20. The inserts 20 may be located on surfaces of the lobes 44, 48 of the stator 6 and the rotor 11. The inserts 20 may be in, on, or over the core 13 of the rotor 11 or over the shell 7 of the stator 6. The inserts 20 may include a hard polycrystalline material, such as diamond, cubic boron nitride, tungsten carbide, or silicon carbide. For example, the inserts 20 may include polycrystalline diamond formed of natural or synthetic diamond crystals. The inserts 20 may include other hard materials instead of or in addition to the hard polycrystalline material, such as zirconia, beryllia, zirconium boride, titanium nitride, tantalum carbide, zirconium carbide, alumina, beryllium carbide, titanium carbide, aluminum boride, or boron carbide.

The inner portion of the stator 6 and the outer portion of the rotor 11 may each include a matrix material 22 adjacent to and in contact with the inserts 20. The matrix material 22 may be selected to provide flexibility and durability to the stator 6 and the rotor 11. For example, the matrix material 22 may elastically deform under load, such that forces on the stator 6 and the rotor 11 may cause deformation of the matrix material 22 rather than deformation or cracking of the inserts 20. Thus, the combination of the inserts 20 and the matrix material 22 may be less brittle and more flexible than a continuous coating of polycrystalline material, yet may have higher hardness and durability than the matrix material 22 alone.

The matrix material 22 may include a metal, such as cobalt, a cobalt-based alloy, iron, an iron-based alloy, nickel, a nickel-based alloy, a cobalt- and nickel-based alloy, an iron- and nickel-based alloy, an iron- and cobalt-based alloy, an aluminum-based alloy, a copper-based alloy, a magnesium-based alloy, or a titanium-based alloy. In some embodiments, the matrix material 22 may also include other materials dispersed therein, such as particles exhibiting a hardness greater than that of the matrix material 22 (e.g., diamond, cubic boron nitride, tungsten carbide, etc.). The harder particles may be mixed with a continuous matrix of metal, which may enhance one or more of the strength, toughness, or modulus of elasticity of the matrix material 22. If the matrix material 22 includes harder particles, the harder particles may have an average particle diameter of, for example, from about 50 μm to about 100 pin, from about 20 μm to about 200 μm, or even from about 10 μm to about 500

μm. In some embodiments, the matrix material 22 may include nanoparticles (i.e., particles having an average particle diameter of less than 1 μm). The matrix material 22 may exhibit a strength from about 10 MPa to about 3,000 MPa, such as from about 100 MPa to about 3,000 MPa or about 500 MPa to about 3,000 MPa. The matrix material 22 may exhibit a toughness from about 0.3 $kJ/m^2$ to about 300 $kJ/m^2$, such as from about 0.5 $kJ/m^2$ to about 100 $kJ/m^2$. The matrix material 22 may exhibit a modulus of elasticity from about 100 GPa to about 400 GPa, such as from about 100 GPa to about 200 GPa.

In some embodiments, the stator 6 and the rotor 11 may be free of elastomeric materials commonly used to provide a fluid seal in some conventional tools. Instead, the matrix material 22 and the inserts 20 of the stator 6 may contact the matrix material 22 and the inserts 20 of the rotor 11 directly. Contact between the matrix material 22 of the stator 6 and the rotor 11 may be referred to in the art as "metal-to-metal" contact. This metal-to-metal contact may form a seal through which any significant volume of drilling fluid 40 cannot pass. Though the inserts 20 need not be metal, contact between an insert 20 and another insert 20 or between an insert 20 and the matrix material 22 may also form a seal. Deformation of the metal of the matrix material 22 during rotation of the rotor 11 may maintain the seal between the inner surface of the stator 6 and the outer surface of the rotor 11. Lack of elastomeric material may allow the hydraulic drilling motor 10 to operate at temperatures above which elastomeric materials typically degrade. For example, the hydraulic drilling motor 10 may be capable of operation at temperatures of at least about 200° C., temperatures of at least about 300° C., or even temperatures of at least about 400° C. without compromising the integrity of the tool components or the seal between the stator 6 and the rotor 11. The maximum operating temperature of the hydraulic drilling motor 10 may vary depending on the composition of the matrix material 22. For example, the maximum operating temperature of the hydraulic drilling motor 10 may be the melting point of the matrix material 22, or may be below the melting point of the matrix material 22 (e.g., below a temperature at which the matrix material 22 begins to soften), such as at least about 50° C. below the melting point of the matrix material 22, at least about 100° C. below the melting point of the matrix material 22, or at least about 200° C. below the melting point of the matrix material 22. In some embodiments, the maximum operating temperature of the hydraulic drilling motor 10 may be selected to have a margin of safety below the melting point of the matrix material 22.

In other embodiments, the matrix material 22 may be an elastomeric material. The matrix material 22 may include, for example, a polymer such as a fluorosilicone rubber (FVMQ, e.g., a copolymer of fluorovinyl and methyl siloxane), nitrile butadiene rubber (NBR), a fluoroelastomer (FKM, e.g., a fluorocarbon copolymer, terpolymer, pentamer, etc.), hydrogenated nitrile butadiene rubber (HNBR), fluorinated ethylene propylene (FEP), vinyl methyl polysiloxane (VMQ), carboxylated nitrile butadiene rubber (XNBR), polyacrylate acrylic rubber (ACM), a perfluoroelastomer (FFKM), ethylene propylene rubber (EPM), ethylene propylene diene monomer rubber (EPDM), or acrylic ethylene copolymer (AEM). The matrix material 22 may be able to return to its original shape after being pulled, stretched, or pressed, and thus, may improve the useful life of the hydraulic drilling motor 10.

The inserts 20 (FIG. 2) may be positioned at points of the stator 6 and/or the rotor 11 expected to experience relatively high loads. The inserts 20 may have a thickness (as measured in a direction normal to the surface of the stator 6 or rotor 11) of at least about 0.5 mm, such as from about 1 mm to about 5 mm (e.g., about 2 mm). In additional embodiments, the inserts 20 may have a thickness of 5 mm or more. The thickness of the inserts 20 may vary based on the expected operating conditions, the composition of the inserts 20, the number of inserts 20, the shape of the inserts 20, the composition of the matrix material 22, or any other relevant factor. For example, cylindrical inserts 20 of polycrystalline diamond may be selected to have a thickness from about 1 mm to about 2 mm, whereas inserts 20 comprising tungsten carbide and having the same shape (as measured normal to the thickness) may have a thickness from about 3 mm to about 5 mm. The thickness of the inserts 20 may be selected based on the load the inserts 20 are expected to experience. For example, inserts 20 expected to experience relatively higher loads may be thicker than inserts 20 expected to experience relatively lower loads.

Figure 3:
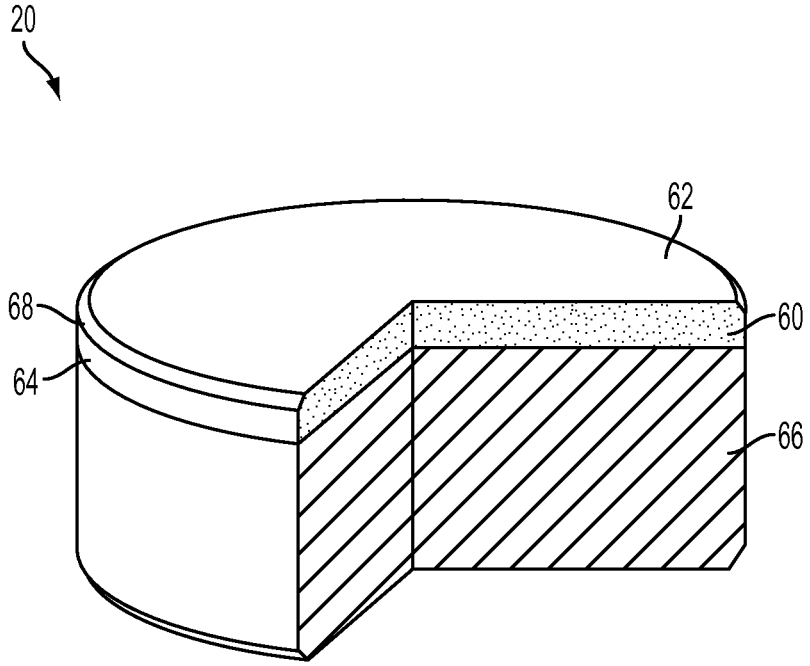
FIG. 3 is a simplified partially cut away perspective view of an embodiment of an insert including a volume of hard polycrystalline material on a substrate.

As shown in FIG. 3, an insert 20 may have a generally cylindrical, or disk-shaped, configuration. The insert 20 includes an exposed, major surface 62 of a hard polycrystalline material 60, which major surface 62 may or may not be planar as depicted. The hard polycrystalline material 60 may comprise a generally planar table in some embodiments. A lateral side surface 64 of the hard polycrystalline material 60 extends from the major surface 62 on a lateral side of the hard polycrystalline material 60. The insert 20 may, optionally, include a substrate 66 to which the hard polycrystalline material 60 is attached. While a planar interface is depicted between the hard polycrystalline material 60 and substrate 66, non-planar interfaces of varying configurations may also be used. In some embodiments, an upper portion of a lateral side surface 64 of the hard polycrystalline material 60 adjacent the major surface 62 may have an angled, frustoconical shape and may define or include, for example, one or more chamfer surfaces 68 of the insert 20. The insert 20 is depicted in FIG. 3 as having a cylindrical cross section, but may have any appropriate shape. In some embodiments, the insert 20 may have a major surface 62 that is contoured to match a surface of a stator 6 or a rotor 11 (FIG. 2). For example, the major surface 62 may be concave, convex, or shaped such that some portions are concave and other portions are convex.

Figure 4:
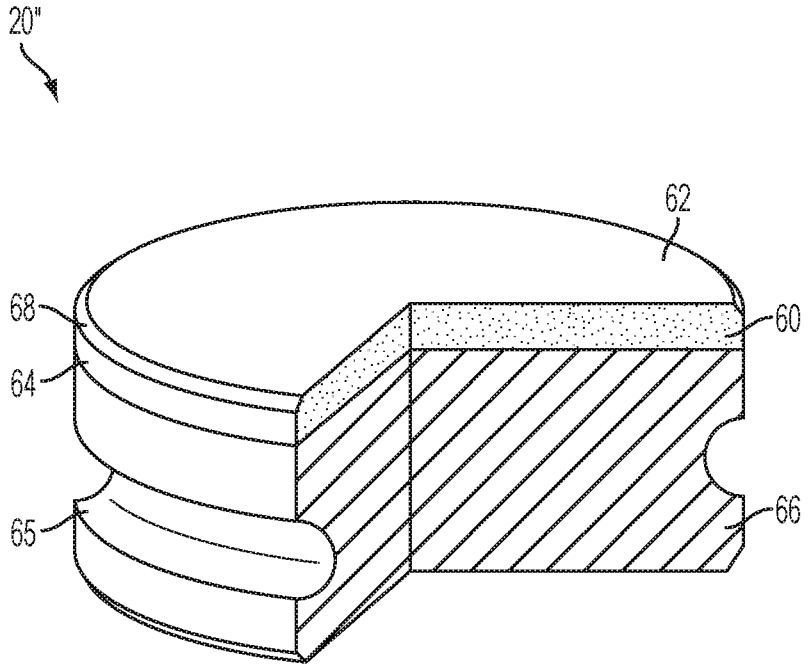
FIG. 4 is a simplified partially cut away perspective view of another embodiment of an insert including a volume of hard polycrystalline material on a substrate.

In some embodiments, and as shown in FIG. 4, an insert 20" may have an outer surface 65 having a concave portion. The outer surface 65 may define a volume that the matrix material 22 (FIG. 2) can fill, such that the matrix material 22 provides a mechanical lock to hold the insert 20" in place during use.

Figure 5:
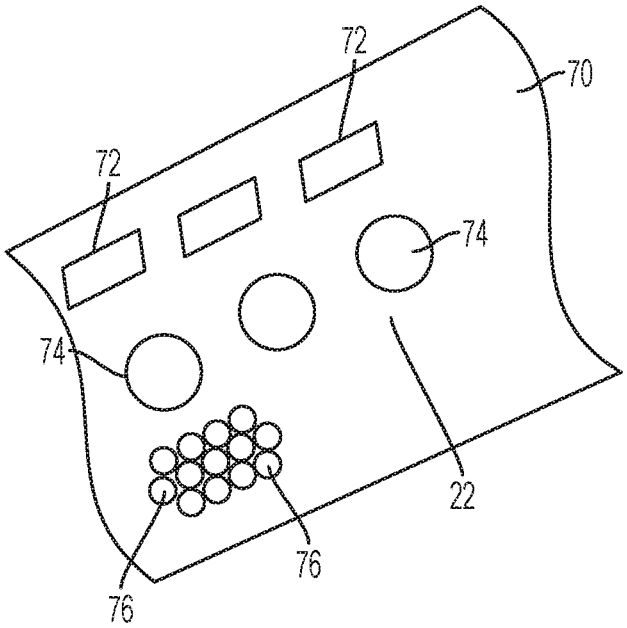
FIG. 5 is a simplified perspective view of a portion of a surface of a tool having inserts thereon.

FIG. 5 shows a portion of a surface 70 (e.g., the inner surface 8 of the stator 6 or the outer surface 12 of the rotor 11) having inserts 72, 74, 76 of various shapes, sizes, and arrangements. Inserts 72 are shown as having approximately rectangular cross sections, and inserts 74 and 76 are shown as having approximately circular cross sections. Inserts 72, 74 are shown as separated by a relatively wide gap, which may be filled by the matrix material 22. In some embodiments, the inserts 72, 74 may be separated from one another by a distance of at least about 1 mm, at least about 5 mm, or even at least about 10 mm. Some inserts 76 may be relatively closer together. For example, the inserts 76 may be separated from adjacent inserts 76 by a distance of about 1 mm or less or even about 0.5 mm or less. In some embodiments, some inserts 76 may be in direct contact with one or more other inserts 76.

Figure 6:
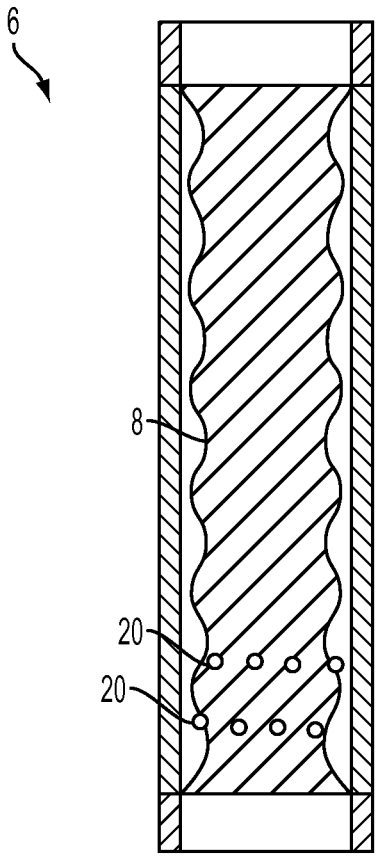
FIG. 6 is a simplified cross-sectional side view of the stator of the hydraulic tool shown in FIGS. 1A and 1B.

The inserts 20 may be in various locations on the surfaces of the stator 6 and/or the rotor 11. For example, FIG. 6 illustrates another view of the stator 6 of the hydraulic drilling motor 10 shown in FIG. 1A. The stator 6 may have inserts 20 located primarily near an end thereof, such as near an end that is expected to be exposed to relatively higher stresses in comparison to other portions of stator 6, such as near the middle of the stator 6 or near the opposite end of the stator 6. In other embodiments, the inserts 20 may be located throughout the length of the stator 6.

Figure 7A:
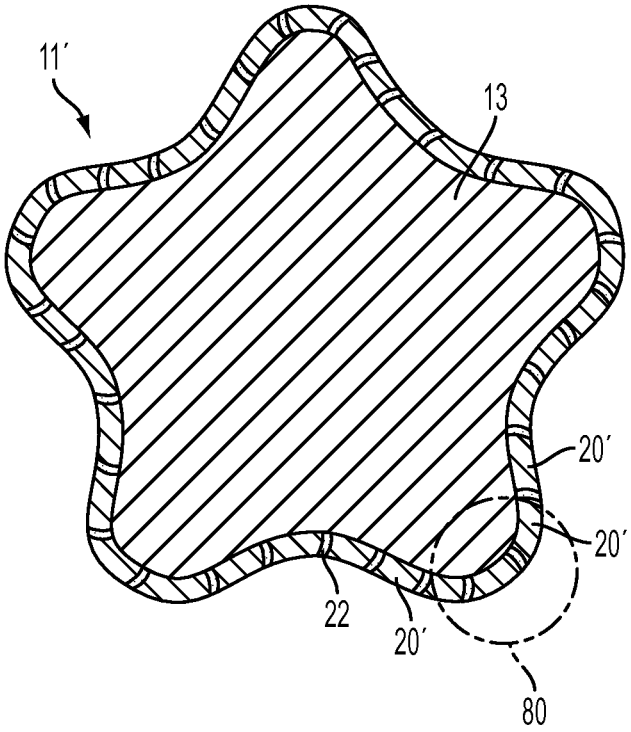
FIG. 7A is a simplified transverse cross-sectional view of a portion of a stator having inserts over its exterior surface.
Figure 7B:
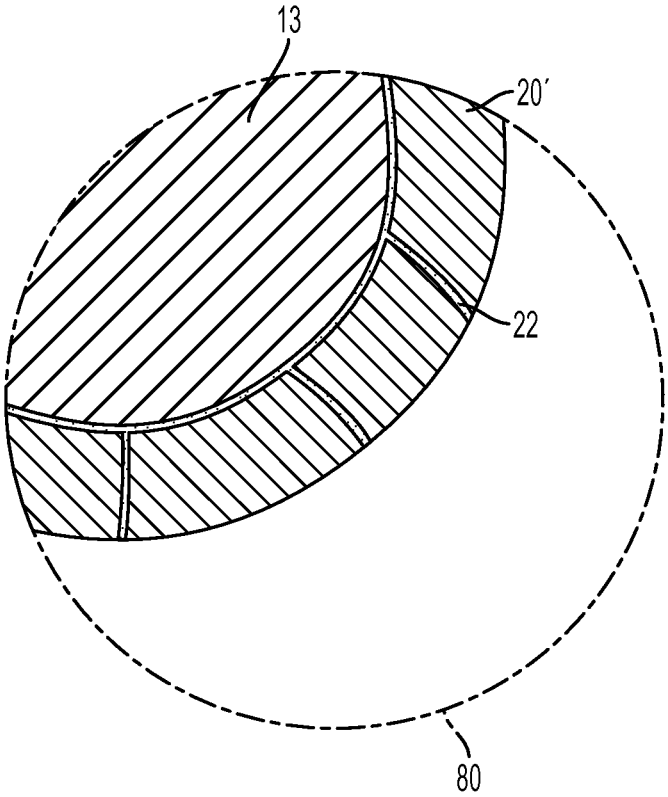
FIG. 7B is an expanded view of a portion of FIG. 7A.

FIGS. 7A and 7B illustrate another rotor 11' with a core 13 having inserts 20' located on an exterior thereof. FIG. 7B illustrates an enlarged detail of the portion of the rotor 11' shown in the circle 80 in FIG. 7A. The inserts 20' may be shaped to form one or more curved surfaces, such as concave surfaces or concave surfaces. In some embodiments, the matrix material 22 may provide a mechanical lock to prevent or limit movement of the inserts 20' from the matrix material 22. The inserts 20' may be shaped such that a volume between adjacent inserts 20' has an approximately uniform thickness. For example, one surface of an insert 20' may be concave, and an adjacent surface of an adjacent insert 20' may be convex having approximately the same curvature. The volume may be filled partially or entirely with the matrix material 22. The matrix material 22 may also fill a volume between the inserts 20' and the core 13 of the rotor 11'.

Figure 8:
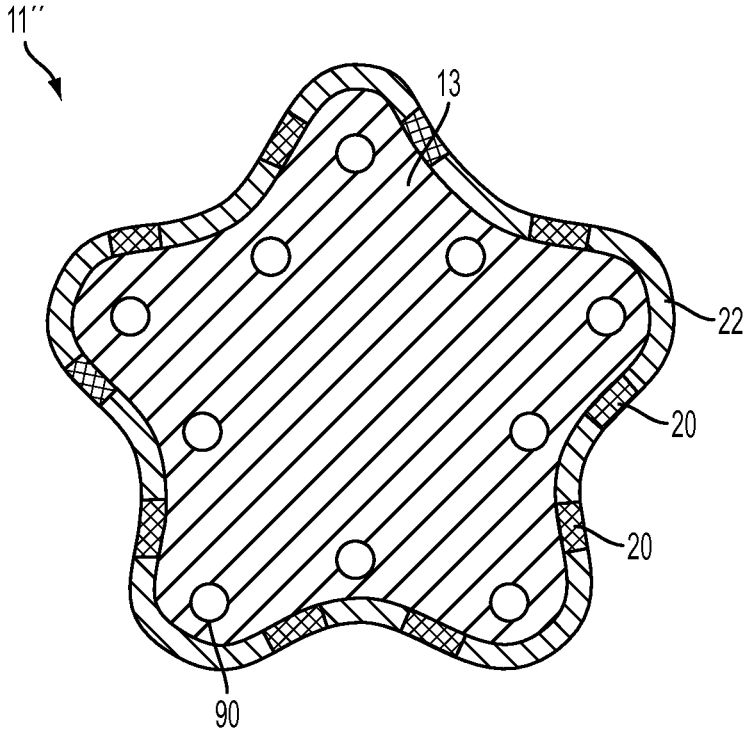
FIG. 8 is a simplified transverse cross-sectional view of a portion of a stator having internal fluid passageways.

As shown in FIG. 8, a rotor 11" may define at least one internal fluid passageway 90 through the core 13 thereof. For example, the rotor 11" may define an even number of fluid passageways 90, such that when the rotor 11" is in use, a fluid may circulate through the fluid passageways 90 to cool the rotor 11". The rotor 11" shown in FIG. 8 includes twice as many internal fluid passageways 90 as lobes 48. Hydraulic drilling motors 10 without an elastomeric material on the rotor 11" or the stator 6 (e.g., metal-to-metal motors) may exhibit relatively high heating loads during use. A cooling fluid (e.g., drilling fluid, water, glycol, etc.) may remove heat from the stator 6 and the rotor 11" to facilitate operations at higher torque and/or speed without damaging the hydraulic drilling motor 10.

Figure 9A:
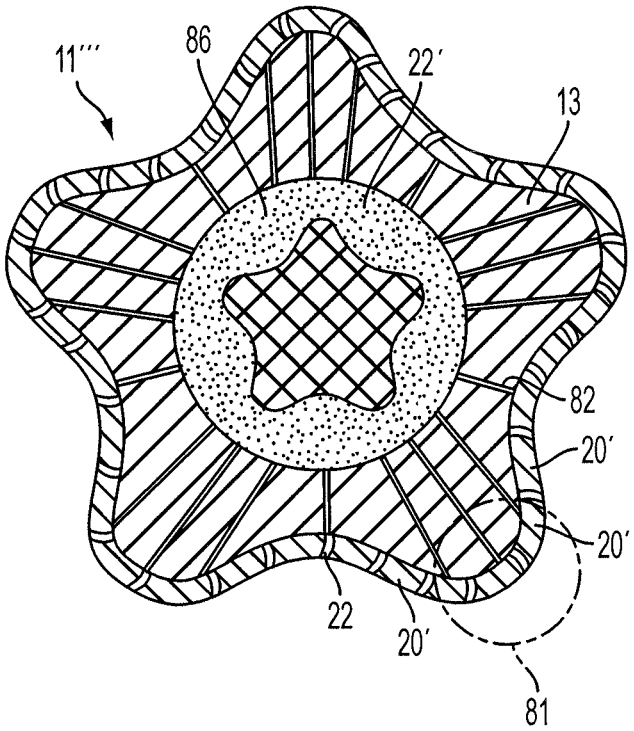
FIG. 9A is a simplified transverse cross-sectional view of a portion of a stator having internal passageways and inserts over its exterior surface.
Figure 9B:
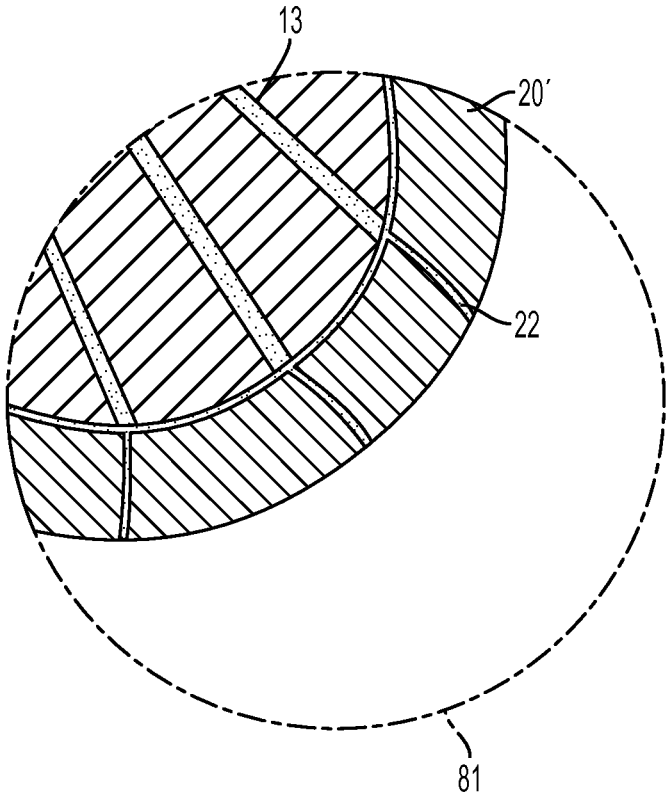
FIG. 9B is an expanded view of a portion of FIG. 9A.

In certain embodiments, the hydraulic drilling motor 10 may operate with a surface or core temperature above a melting point of the matrix material 22. For example, a rotor 11' as shown in FIG. 9A, may include one or more radial passageways 82 through which matrix material 22 may flow from a reservoir 22' within the rotor 11'". FIG. 9B illustrates an enlarged detail of the portion of the rotor 11' shown in the circle 81 in FIG. 9A. The rotor 11'" may include a fluid 86 configured to maintain pressure on the reservoir 22'. As the matrix material 22 adjacent the inserts 20' melts, a portion of the matrix material 22 may be extruded between adjacent inserts 20'. The fluid 86 may push additional matrix material from the reservoir 22' to replace lost matrix material 22 and maintain the inserts 20'. The fluid may be a drilling fluid or another material supplied through a drill string (e.g., water, pressurized air, etc.).

Figure 10A:
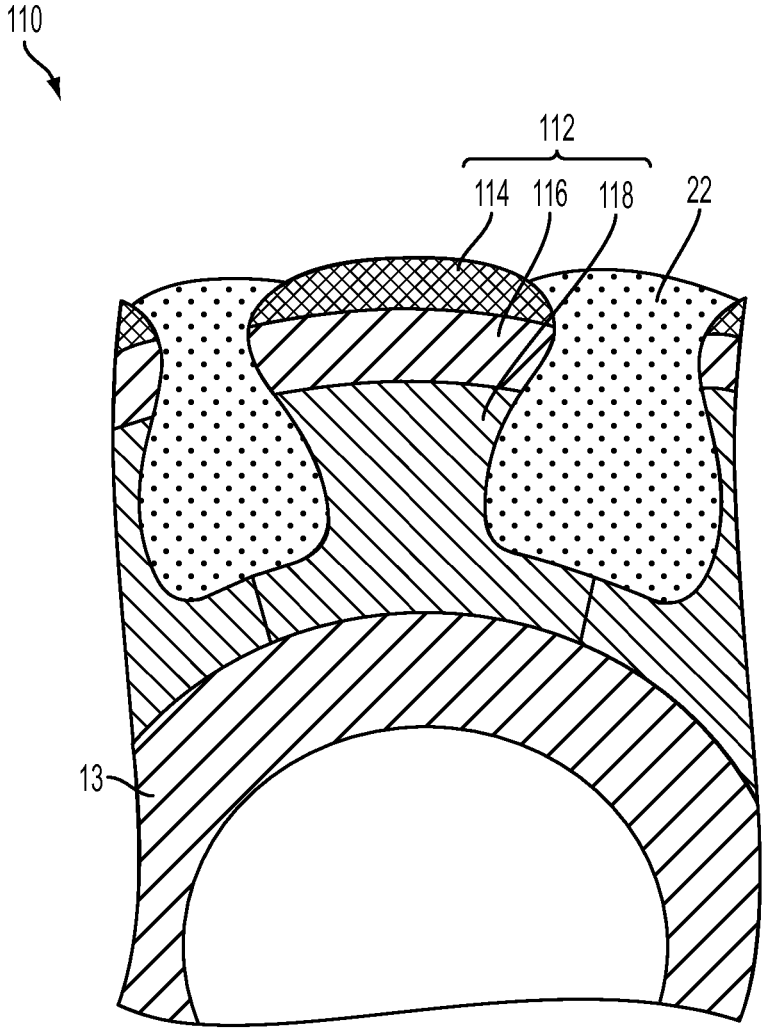
FIGS. 10A through 10C are simplified cross-sectional views of portions of another rotor according to the current disclosure.

FIG. 10A shows a portion of another rotor 110 according to the current disclosure. The rotor 110 includes a core 13 over which inserts 112 are disposed. The inserts 112 may include a polycrystalline portion 114 over a support 116, and the support 116 may be over a base 118. The polycrystalline portion 114 may be, for example, polycrystalline diamond or another hard material. The polycrystalline portion 114 may be relatively thin, such as about 1 mm measured in a direction normal to an exposed surface thereof. The polycrystalline portion 114 may be formulated to have a high wear resistance. The support 116 may include a material having a high hardness, such as tungsten carbide. The support 116 may be relatively thicker (e.g., about 3 mm thick) than the polycrystalline portion 114 to provide rigidity to the polycrystalline portion 114 and avoid breakage of the polycrystalline portion 114. The base 118 may include a relatively softer material, such as a metal (e.g., Ti) or alloy formulated to provide flexibility. Thus, when forces act upon the exposed surface of the polycrystalline portion 114, the base 118 allows the polycrystalline portion 114 and the support 116 to move without breaking. A matrix material 22, as described above, may be between adjacent inserts 112 and between the inserts 112 and the core 13.

Figure 10B:
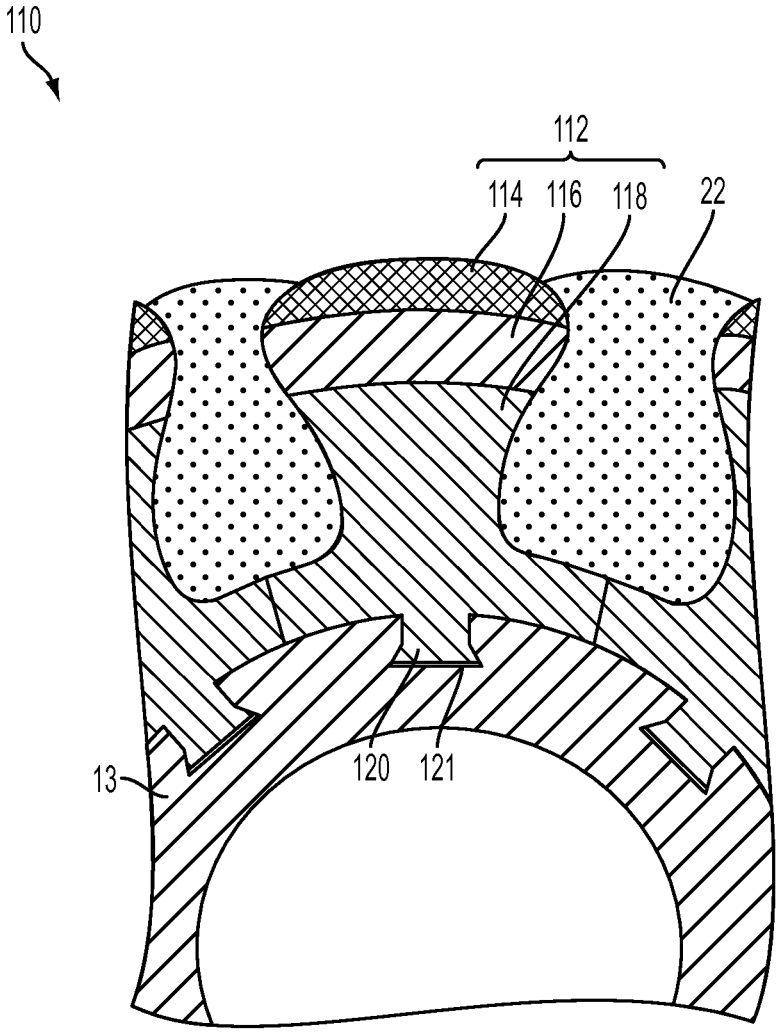

FIG. 10B shows how the inserts 112 may be secured to the core 13 of the rotor 110. An insert 112 may be secured by a dovetail joint. For example, the base 118 of the insert 112 may include a tail 120, and the core 13 may include a corresponding socket 121. The tail 120 may slide into the socket 121, but the dimensions of the tail 120 and socket 121 may restrict movement of the insert 112 outward from the core 13.

Figure 10C:
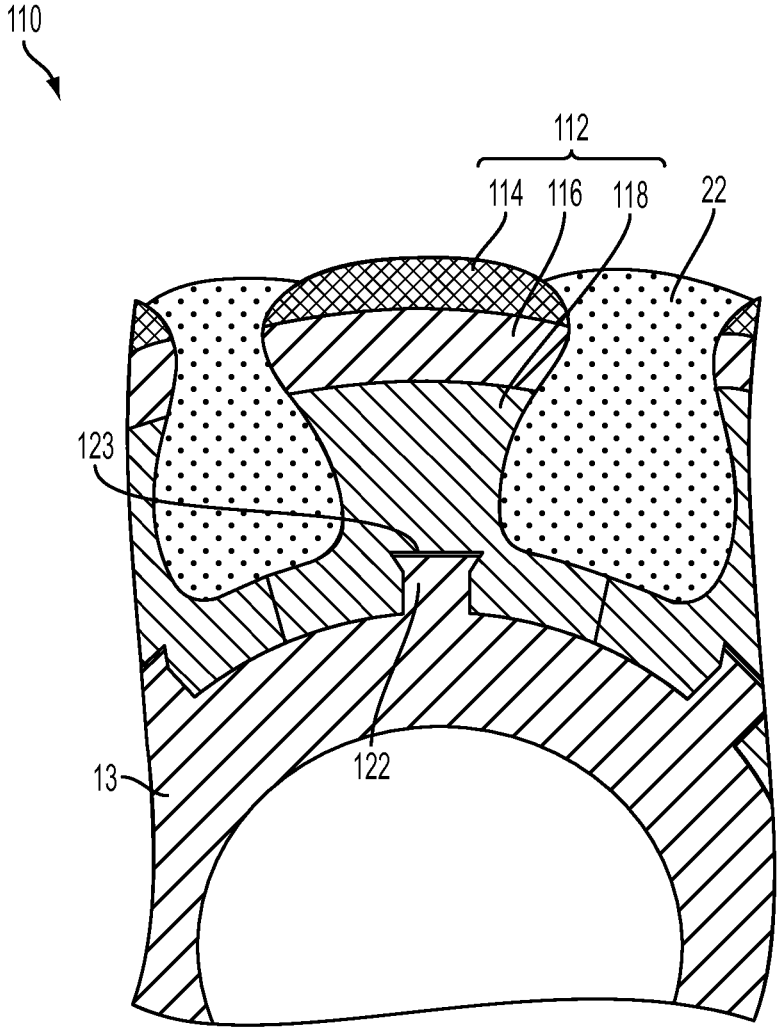

FIG. 10C shows another dovetail joint that may secure the insert 112 to the core 13. For example, the core 13 may include a tail 122, and the base of the insert 112 may include a corresponding socket 123. The tail 122 may slide into the socket 123, but the dimensions of the tail 122 and socket 123 may restrict movement of the insert 112 outward from the core 13.

The dovetail joints shown in FIGS. 10B and 10C may operate as fixtures and/or placement guides for components before molding the inserts 112 with matrix material 22. In some embodiments, such fixtures may securely maintain the inserts 112 without the matrix material 22. Thus, the matrix material 22 may optionally be omitted, or the matrix material 22 may be applied after the inserts 112 are already placed. The use of alignment features such as the dovetail joints may facilitate replacement of worn inserts 112 after inspection, and thus may reduce maintenance costs and downtime.

Figure 11:
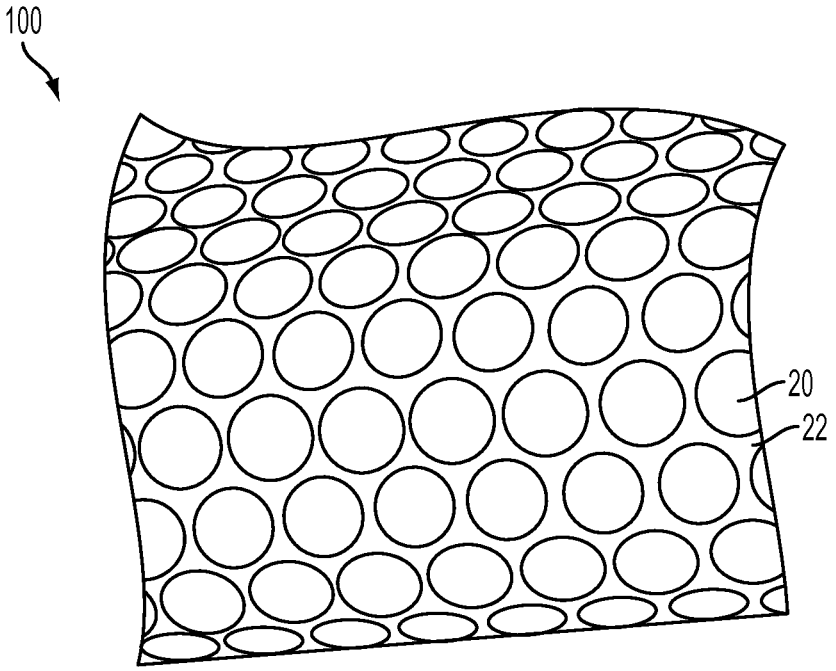
FIG. 11 is a simplified perspective view of a sheet of matrix material with inserts that may be used to form the tools of the present disclosure.
Figure 12:
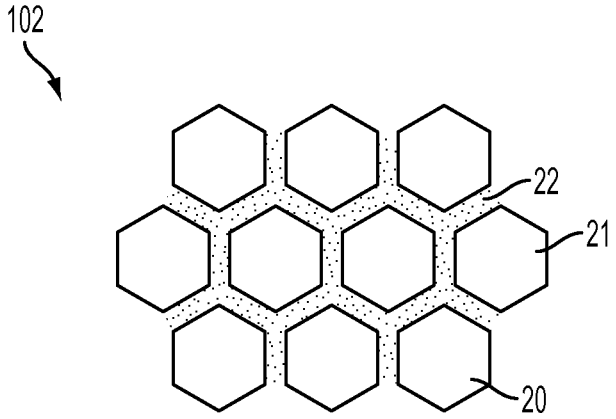
FIG. 12 is a simplified top view of another sheet of matrix material with inserts.

In some embodiments, methods of forming the hydraulic drilling motor 10 may include attaching at least one insert 20 to a surface of the stator 6, a surface of the rotor 11, or both. The inserts 20 may be secured to the stator 6 and/or the rotor 11 by the matrix material 22. For example, the matrix material 22 may be molded to abut the inserts 20 adjacent the core 13 of the rotor 11 or the shell 7 of the stator 6. In some embodiments, and as shown in FIG. 11, inserts 20 may be disposed on a sheet 100 of the matrix material 22. FIG. 12 illustrates another sheet 102 of matrix material 22 on or in which hexagonal inserts 21 may be disposed. The hexagonal inserts 21 may be spaced such that the width of the matrix material 22 is approximately uniform between adjacent inserts 21. Inserts 20, 21, may be any appropriate shape. The sheets 100, 102 may be deformed to conform to the shape of the core 13 of the rotor 11 or the shell 7 of the stator 6. For example, the sheets 100, 102 may be heated and pressed over the core 13 to bond the sheets 100, 102 to the core 13. Side surfaces of the sheets 100, 102 may be connected to one another such that the sheets 100, 102 cover all the way around an exterior of the core 13 or an interior of the shell 7. A portion of the matrix material 22 at one surface or edge of the sheets 100, 102 may be bonded to another portion of the matrix material 22 at another surface or edge of the sheets 100, 102. The sheets 100, 102 may include an adhesive material to facilitate placement of the sheets 100, 102. The adhesive material, if present, may melt or decompose during subsequent processing.

To form a stator 6, the sheet 100 (or the sheet 102) may be pressed over a mold shaped like the interior surface of the stator 6. After forming the sheet 100 to conform to the mold, the shell 7 of the stator 6 may be formed over and in contact with the sheet 100. For example, the shell 7 may be cast around the sheet 100. The mold may be removed from within the sheet 100 before or after forming the shell 7. Because stators 6 may be relatively long, precisely securing inserts 20 toward the middle of a stator 6 may be relatively difficult after the shell 7 has been formed. By forming the shell 7 of the stator 6 around the sheet 100 comprising the inserts 20 rather than preforming the shell 7, the inserts 20 may be placed along the length of the stator 6, rather than only near the ends.

In some embodiments, a portion of the sheet 100 may be removed, such as by machining. Portions of the matrix material 22 and/or the inserts 20 may be removed to form the rotor 11 and stator 6 into appropriate shapes for use in the hydraulic drilling motor 10, such as to promote proper sealing between the rotor 11 and the stator 6.

Figure 13:
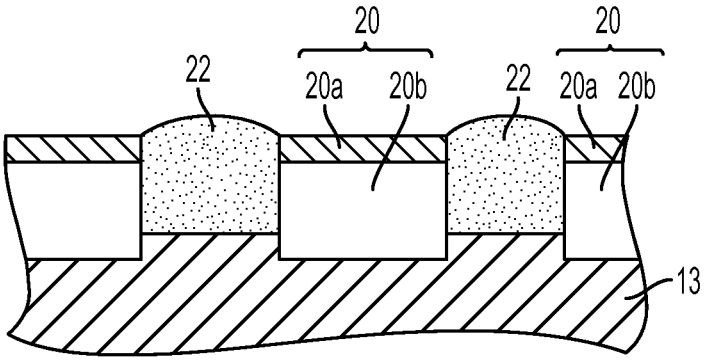
FIG. 13 is a simplified cross-sectional view of a portion of another rotor according to the current disclosure.

Another view of a portion of stator 11 is shown in FIG. 13. The inserts 20 may include an upper portion 20*a* and a lower portion 20*b*. The matrix material 22 may fill a volume between adjacent inserts 20. The inserts 20 and the matrix material 22 may overlie the core 13. Table 1 below indicates one group of relative mechanical properties of the upper portion 20*a* and lower portion 20*b* of the inserts and the matrix material 22. The terms "high," "medium high," "medium," "medium low," and "low" are relative to one another. Thus, though the material 22 is listed as having "low" hardness, this means only that its hardness is lower than the materials 20*a* and 20*b* having "medium low" and "high" hardness.

TABLE 1

| Material | Hardness | Ductility | Elasticity | Mechanical Strength |
|---|---|---|---|---|
| 20a | High | Low | Medium Low | Medium High |
| 20b | Medium Low | Low | Medium High | Medium |
| 22 | Low | High | Medium | Low |

As shown in Table 1, the upper portion 20*a* of the inserts 20 may be relatively harder than both the lower portion 20*b* of the inserts 20 and the matrix material 22 to provide a resistance to wear when forces act on the upper portion 20*a* of the insert 20. The matrix material 22 may have a relatively higher ductility than the upper portion 20 and the lower portion 20*b* of the inserts 20, such that the matrix material 22 may flex and allow the inserts 20 to move. With materials having the relative properties shown in Table 1, the inserts 20 may resist cracking during use.

Systems with hydraulic drilling motors as described herein may be used in the exploration and production of deep, high-enthalpy geothermal energy, by providing the ability to operate in high-temperature environments in deep crystalline rock. Furthermore, hydraulic drilling motors as described may have higher wear resistance to abrasive particles than conventional motors.

Additional non limiting example embodiments of the disclosure are described below.

Embodiment 1

A hydraulic tool comprising a stator and a rotor rotatably disposed within the stator. The rotor has a plurality of lobes, and the rotor has one fewer lobe than the stator. The lobes of the rotor are configured to engage with the lobes of the stator when the rotor moves. At least one of at least an inner portion of the stator and at least an outer portion of the rotor comprises at least one insert comprising a hard material.

Embodiment 2

The hydraulic tool of Embodiment 1, wherein the hard material comprises a polycrystalline material.

Embodiment 3

The hydraulic tool of Embodiment 1 or Embodiment 2, wherein the hard material comprises a material having a hardness equal to or exceeding a hardness of tungsten carbide.

Embodiment 4

The hydraulic tool of any of Embodiments 1 through 3, wherein the at least one of at least an inner portion of the stator and at least an outer portion of the rotor comprises a matrix material at least partially surrounding the at least one insert.

Embodiment 5

The hydraulic tool of Embodiment 4, wherein the matrix material comprises a material having a higher flexibility than the material of the at least one insert.

Embodiment 6

The hydraulic tool of Embodiment 4 or Embodiment 5, wherein the matrix material comprises particles of hard material.

Embodiment 7

The hydraulic tool of Embodiment 6, wherein the particles of hard material have an average particle size from about 50 μm to about 100 μm.

Embodiment 8

The hydraulic tool of any of Embodiments 1 through 7, wherein the at least one insert comprises a plurality of laterally adjacent inserts.

Embodiment 9

The hydraulic tool of any of Embodiments 1 through 8, wherein the at least one insert has a thickness of at least 1 mm.

Embodiment 10

The hydraulic tool of any of Embodiments 1 through 9, wherein the rotor is configured to form a metal-to-metal seal against the stator as the rotor rotates within the stator.

Embodiment 11

The hydraulic tool of any of Embodiments 1 through 10, wherein the rotor defines at least one internal passageway.

Embodiment 12

The hydraulic tool of any of Embodiments 1 through 11, wherein the hydraulic tool is configured to be attached to at least one of an earth-boring bit and a drill string.

Embodiment 13

A method of forming a hydraulic tool comprising attaching at least one insert comprising a hard material to an inner surface of a stator or an outer surface of a rotor of the hydraulic tool.

Embodiment 14

The method of Embodiment 13, wherein attaching at least one insert comprising a hard material to an inner surface of a stator or an outer surface of a rotor comprises attaching a matrix material comprising a metal to at least one of the inner surface of the stator and the outer surface of the rotor.

Embodiment 15

The method of Embodiment 14, wherein attaching a matrix material comprising a metal to at least one of the inner surface of the stator and the outer surface of the rotor comprises deforming the matrix material to define at least one of at least an inner portion of the stator and at least an outer portion of the rotor.

Embodiment 16

The method of Embodiment 15, further comprising bonding a portion of the matrix material to another portion of the matrix material.

Embodiment 17

The method of any of Embodiments 14 through 16, further comprising removing a portion of at least one of the insert and the matrix material from the hydraulic tool.

Embodiment 18

The method of Embodiment 17, wherein removing a portion of at least one of the insert and the matrix material from the hydraulic tool comprises at least one of machining or grinding a surface of the hydraulic tool.

Embodiment 19

A downhole motor or pump comprising a stator and a rotor rotatably disposed within the stator. The stator comprises at least one insert comprising a hard material disposed over at least a portion of an interior surface thereof. The stator also comprises a matrix material at least partially surrounding the at least one insert. The rotor comprises at least one insert comprising a hard material disposed over at least a portion of an exterior surface thereof. The rotor also comprises a matrix material at least partially surrounding the at least one insert.

Embodiment 20

The downhole motor or pump of Embodiment 19, wherein the rotor is configured such that the at least one insert of the rotor contacts the at least one insert of the stator intermittently when the rotor rotates within the stator.

Embodiment 21

The downhole motor or pump of Embodiment 19 or Embodiment 20, wherein the exterior surface of the rotor and the interior surface of the stator are each free of an elastomeric material.

Embodiment 22

The downhole motor or pump of any of Embodiments 19 through 21, wherein materials of the rotor and materials of the stator are each stable at temperatures of at least 300° C.

Embodiment 23

A hydraulic tool comprising a stator and a rotor rotatably disposed within the stator. The rotor defines at least one fluid passageway within the rotor.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A hydraulic tool, comprising: a stator having a plurality of lobes; and a rotor rotatably disposed within the stator, the rotor having one fewer lobe than the stator, wherein the lobes of the rotor are configured to engage with the lobes of the stator when the rotor moves; and at least one insert, the at least one insert comprising a volume of a hard material attached to a substrate, the volume of said hard material having a Knoop hardness value of about 800 Kgf/mm2 (7,845 MPa) or more and having a thickness of at least 1 mm, wherein a major surface of the at least one insert forms at least one of at least an inner portion of the stator and at least an outer portion of the rotor.

2. The method of claim 1, wherein molding a matrix material comprises deforming the matrix material to define at least one of at least an inner portion of the stator and at least an outer portion of the rotor.

3. The method of claim 2, further comprising bonding a portion of the matrix material to another portion of the matrix material.

4. The method of claim 1, further comprising removing a portion of at least one of the at least one insert and the matrix material from the hydraulic tool.

5. The method of claim 4, wherein removing a portion of at least one of the at least one insert and the matrix material from the hydraulic tool comprises at least one of machining or grinding a surface of the hydraulic tool.

6. The method of claim 1, further comprising forming a sheet of the matrix material and disposing the at least one insert within the sheet.

7. A hydraulic tool, comprising:

a stator having a plurality of lobes; and a rotor rotatably disposed within the stator, the rotor having one fewer lobe than the stator, wherein the lobes of the rotor are configured to engage with the lobes of the stator when the rotor moves; and at least one insert, the at least one insert comprising a volume of a hard material and a substrate, a volume of the hard material being bonded to the substrate, the hard material having a Knoop hardness value of about 800 $Kg_f/mm^2$ (7,845 MPa) or more and having a thickness of at least 1 mm, wherein a major surface of the at least one insert forms at least one of at least an inner portion of the stator and at least an outer portion of the rotor.

8. The hydraulic tool of claim 7, wherein the hard material comprises a polycrystalline material.

9. The hydraulic tool of claim 7, wherein the hard material comprises a material having a hardness equal to or exceeding a hardness of tungsten carbide.

10. The hydraulic tool of claim 7, wherein the at least one of at least an inner portion of the stator and at least an outer portion of the rotor comprises a matrix material at least partially surrounding the at least one insert.

11. The hydraulic tool of claim 10, wherein the matrix material comprises a material having a higher flexibility than the material of the at least one insert.

12. The hydraulic tool of claim 10, wherein the matrix material comprises particles of hard material.

13. The hydraulic tool of claim 12, wherein the particles of hard material have an average particle size from about 50 μm to about 100 μm.

14. The hydraulic tool of claim 7, wherein the at least one insert comprises a plurality of inserts laterally adjacent one another.

15. The hydraulic tool of claim 7, wherein the rotor is configured to form a metal-to-metal seal against the stator as the rotor rotates within the stator.

16. The hydraulic tool of claim 7, wherein the rotor defines at least one internal passageway.

17. The hydraulic tool of claim 7, wherein the hydraulic tool is configured to be attached to at least one of an earth-boring bit and a drill string.

18. A downhole motor or pump, comprising:

a stator comprising at least a first insert comprising a first volume of hard material attached to a first substrate and having a major surface that forms a portion of an interior surface of the stator, and a matrix material partially surrounding the at least a first insert; and a rotor rotatably disposed within the stator, the rotor comprising at least a second insert, the at least a second insert comprising a second volume of hard material attached to a second substrate and having a major surface that forms a portion of an exterior surface of the rotor, and a matrix material partially surrounding the at least a second insert;

wherein the first and second volume of hard material each has a Knoop hardness value of about 800 $Kg_f/mm^2$ (7,845 MPa) or more and a thickness of at least 1 mm.

19. The downhole motor or pump of claim 18, wherein the first and second volumes of hard material comprise polycrystalline diamond, and wherein the first and second substrates comprise tungsten carbide.

20. The downhole motor or pump of claim 19, wherein the rotor is configured such that the at least a second insert of the rotor contacts the at least a first insert of the stator intermittently when the rotor rotates within the stator.

* * * * *